United States Patent [19]

Chun

[11] Patent Number: 4,876,748

[45] Date of Patent: Oct. 31, 1989

[54] TOILET ODOR FILTER ASSEMBLY

[76] Inventor: Duk K. Chun, 6811 - 32 Avenue, Edmonton, Canada, T6K 1L8

[21] Appl. No.: 163,773

[22] Filed: Mar. 3, 1988

[51] Int. Cl.[4] ..... E03D 9/05

[52] U.S. Cl. ..... 4/213

[58] Field of Search ..... 4/213, 216, 217

[56] References Cited

U.S. PATENT DOCUMENTS

| | | | |
|---|---|---|---|
| 997,442 | 7/1911 | Diffenderfer | 4/213 |
| 1,798,457 | 3/1931 | Cole | 4/213 |
| 2,017,590 | 10/1935 | Duffner | 4/213 |
| 3,335,431 | 8/1967 | Coates . | |
| 3,366,979 | 2/1968 | Johnston | 4/213 |
| 3,491,382 | 1/1970 | Poister | 4/217 |
| 3,571,824 | 3/1971 | Poister . | |
| 3,763,505 | 10/1973 | Zimmerman . | |
| 3,824,637 | 7/1974 | Hunnicutt, Jr. . | |
| 3,849,808 | 11/1974 | Olson et al. . | |
| 3,857,119 | 12/1974 | Hunnicutt | 4/213 |
| 3,869,737 | 3/1975 | Stevenson . | |
| 3,887,948 | 6/1975 | Stamper | 4/213 |
| 3,902,203 | 9/1975 | Poister et al. . | |
| 3,927,429 | 12/1975 | Pearson | 4/213 |
| 4,059,857 | 11/1977 | Poister . | |
| 4,200,940 | 5/1980 | Buchanan . | |
| 4,317,242 | 3/1982 | Stamper . | |
| 4,472,841 | 9/1984 | Faulkner . | |

*Primary Examiner*—Charles E. Phillips

*Attorney, Agent, or Firm*—Fleit, Jacobson, Cohn, Price, Holman & Stern

[57] ABSTRACT

An elongated hollow housing is provided including air inlet means at one end, air outlet means at the other end, intermediate length air filtering panel means within the housing intermediate the air inlet means and the air outlet means, an electric motor mounted within the other end of the housing and including a rotatable output shaft portion extending toward the air inlet means end of the housing and a pair of axial flow impellers mounted on the rotary output shaft within the housing on opposite sides of the air filtering panel means. The air filtering panel means comprise separate air filtering panels mounted within the housing on opposite sides of the motor output shaft and one peripheral side wall of the housing includes a removable portion thereof registrable with the air filtering panels enabling removal and replacement of the latter through the aforementioned opening when the removable periperal side wall portion is removed.

3 Claims, 2 Drawing Sheets

TOILET ODOR FILTER ASSEMBLY

BACKGROUND OF THE INVENTION

1. FIELD OF THE INVENTION

A bathroom accessory is provided for use in conjunction with a toilet bowl and is operative to vacuum gasses from within the toilet bowl and to pass the gasses evacuated from the toilet bowl through an activated charcoal filter and thereafter in close proximity to air freshening material before being exhausted back into the bathroom.

2. DESCRIPTION OF RELATED ART

Various different forms of toilet bowl ventilating and deodorizing structures heretofore have been provided such as those disclosed in U.S. Pat. Nos. 3,335,431, 3,571,824, 3,763,505, 3,824,637, 3,849,808, 3,869,737, 3,902,203, 4,059,857, 4,200,940, 4,317,242 and 4,472,841. However, these previously known forms of toilet bowl venting and deodorizing structures do not include the overall structural and operational features of the instant invention.

SUMMARY OF THE INVENTION

The toilet bowl venting and deodorizing structure of the instant invention incorporates a single housing having opposite ends, a removable end wall closing one end of the housing and being equipped with an inlet opening, a motor mounted from the other end wall of the housing and including a rotatable output shaft projecting toward the removable end wall of the housing, a transverse activated charcoal filter assembly mounted within an intermediate length portion of the housing and including a plurality of filter panel sections disposed outwardly of the output shaft and separable along paths extending generally radially of the output shaft, a lateral opening in one peripheral wall portion of the housing through which the filter panel sections may be removed and replaced and closed by a removable panel section, a pair of axial flow impellers mounted on the output shaft on opposite sides of the activated charcoal filter assembly, a lateral outlet in at least one housing peripheral wall portion intermediate the motor and the adjacent axial flow impeller and a deodorizing agent mounted outwardly of the motor within the housing and closely adjacent the lateral outlet.

The inlet opening is adapted to be communicated with an area adjacent the upper rim portion of an associated toilet bowl through the utilization of a flexible conduit and the motor is operably connected to a suitable source of electrical potential through a pressure switch designed to be closed upon downward force being applied to the hinged seat portion of the associated toilet bowl.

The main object of this invention is to provide an apparatus for ventilating the interior of a toilet bowl during usage thereof and with the gasses vented from the interior of the filter bowl being passed through a suitable filter assembly and closely adjacent a deodorizing agent subsequent to discharge back into the ambient atmosphere.

Another object of this invention is to provide a toilet bowl ventilating and deodorizing system in accordance with the preceding object and constructed in a manner to be powered by a suitable storage battery pack, thereby enabling the system to be utilized within bathrooms covered by local ordinances which do not allow similar electrical appliances to be connected to a domestic electrical supply through the utilization of an extension cord.

A further object of this invention is to provide a system including a housing for the air pumping, air filtering and air deodorizing portions of the system and with the housing constructed in a manner enabling ready servicing of the system.

Still another important object of this invention is to provide a system wherein toilet bowls of different designs may be readily ventilated thereby.

A final object of this invention to be specifically enumerated herein is to provide a toilet bowl ventilating and deodorizing system in accordance with the preceding objects and which will conform to conventional forms of manufacture, be of simple construction and easy to use so as to provide a device that will be economically feasible, long-lasting and relatiely trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
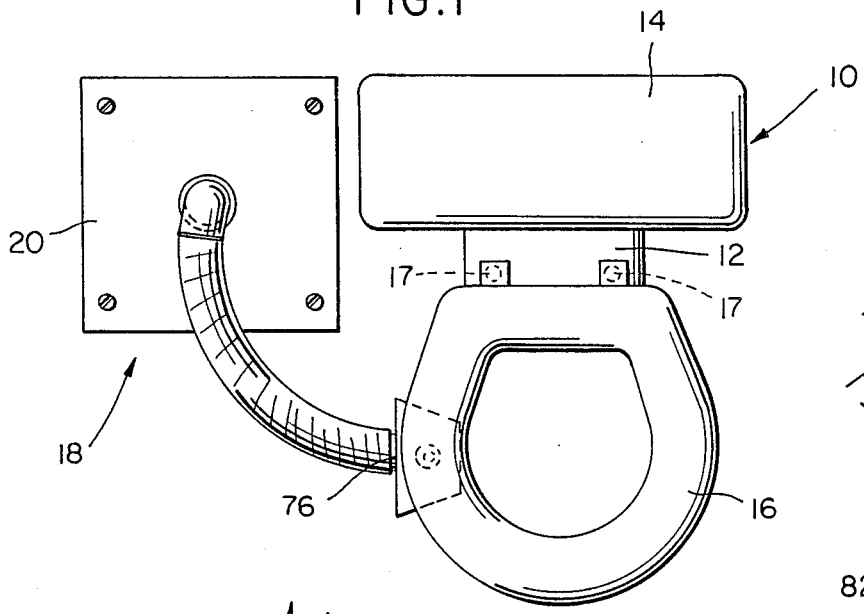
FIG. 1 is a top plan view of a typical toilet bowl, tank and seat assembly with the toilet bowl ventilating and deodorizing structure of the instant invention operatively associated therewith.

Referring now more specifically to the drawings, the numeral 10 generally designates a typical form of toilet assembly including a toilet bowl 12, a flush tank 14 and a seat 16 hingedly supported from the bowl 12.

The toilet bowl ventilating and deodorizing structure of the instant invention is referred to in general by the reference numeral 18 and incorporates an elongated hollow housing 20 which defines a quadrilateral in cross-section and includes a first removable end wall 22 having a tubular inlet nipple 24 opening therethrough. The housing 20 also includes a second end wall 26 and peripheral walls 28, 29, 30 and 32 extending between and interconnecting the end walls 22 and 26.

The end portions of the peripheral walls 28, 29, 30 and 32 adjacent the end wall 26 include gas discharge outlet openings 36 formed therein and one end of an electric motor 38 is mounted to the inner surface of the end wall 26 through the utilization of removable fasteners 39 and the end wall 26 includes ventilation openings 40 formed therein for discharging cooling air passing longitudinally through the motor 38. In addition, the end wall 26 comprises a lower end wall of the housing 20 when the latter is disposed upright and is provided with downwardly projecting corner foot portions 42 for support of the housing 20 from a floor surface or the like closely adjacent the toilet assembly 10.

The motor 38 includes an upwardly projecting rotary output shaft 44 whose upper free end terminates closely inward of the upper removable end wall 22 and is journalled from a spider assembly 46 removably telescopingly receivable within the upper end of the housing 20 when the upper end wall 22 has been removed. In addition, a longitudinal mid-portion of the housing 20 includes inwardly projecting flange portions 48 upon which a pair of somewhat deformable activated charcoal filter panels 50 are supported on opposite sides of the shaft 44.

The upper portion 52 of the peripheral wall 28 is removably supported from the housing 20 through the utilization of suitable removable fasteners 54 and the filter panels 50 may be removed through the opening 55 in the peripheral wall 28 of the housing 20 defined by removal of the upper portion 52, the filter panels 50 including adjacent edges extending along generally diametrically opposite radii of the shaft 44.

The shaft 44 has a first or upper axial flow impeller 58 mounted thereon beneath the spider 46 and above the panels 50 and a second lower axial flow impeller 60 mounted thereon below the filter panels 50 and above the openings 36.

Figure 2:
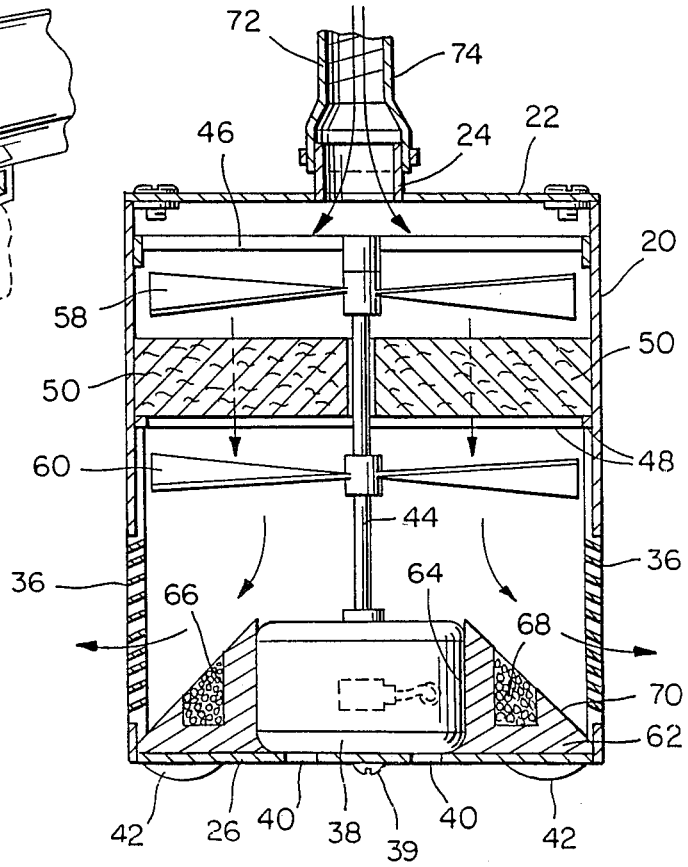
FIG. 2 is an enlarged fragmentary vertical sectional view taken substantially upon a plane passing through the center of the housing portion of the toilet bowl ventilating and deodorizing structure.
Figure 4:
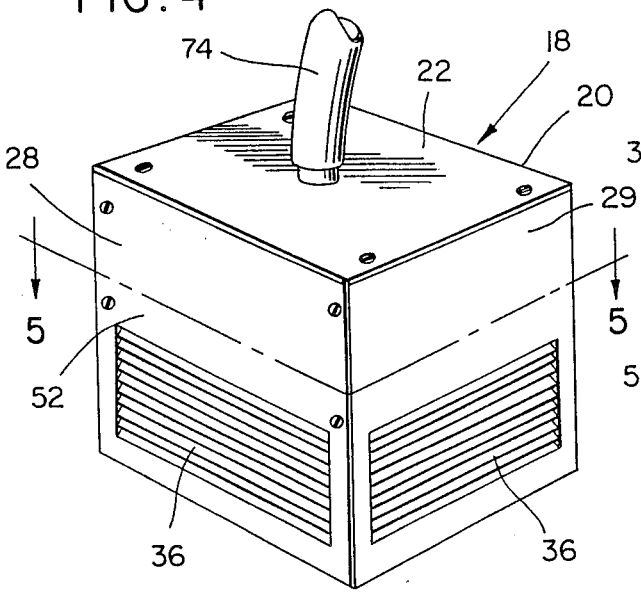
FIG. 4 is an enlarged perspective view of the housing portion of the invention.
Figure 5:
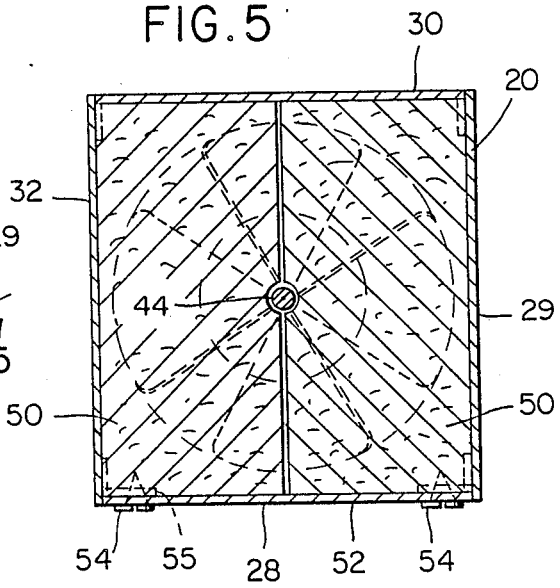
FIG. 5 is a horizontal sectional view taken substantially upon the plane indicated by the section line 5—5 of FIG. 4.

With attention invited more specifically to FIG. 2 of the drawings, a rectangular body 62 is disposed in the lower portion of the housing 20 and abuts the upper surface of the end wall 26. The body 62 defines a center recess 64 in which the outer periphery of the lower end of the motor 38 is seatingly received and the body 62, accordingly, is mounted against the inner surface of the end wall 26 by the fasteners 38 which secure the motor 38 to the end wall 26. In addition, the body 62 includes a peripheral upwardly opening groove formed therein in which a quantity of deodorizing material 68 is disposed and the upper marginal portions of the body 62 are downwardly and outwardly inclined as at 70 at approximately 45° relative to the longitudinal center axis of the shaft 44.

The inlet nipple 24 has the outlet end 72 of a flexible conduit 74 sealingly telescoped thereover and the inlet end of the conduit 74 opens into the outlet neck 76 of an inlet fitting 78 interposed between the upper rim portion 80 of the bowl 12 and the opposing portion of the seat 16, the fitting 78 supporting a pressure activated switch 80 therefrom.

Figure 6:
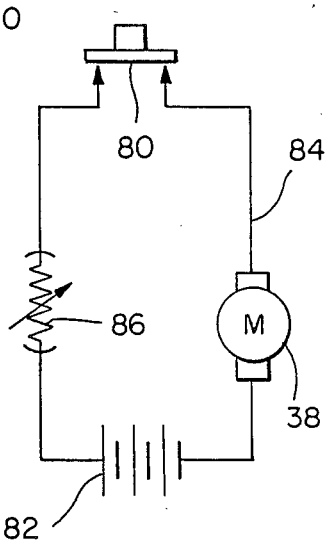
FIG. 6 is a wiring diagram of the electrical circuit incorporated in the invention.
Figure 3:
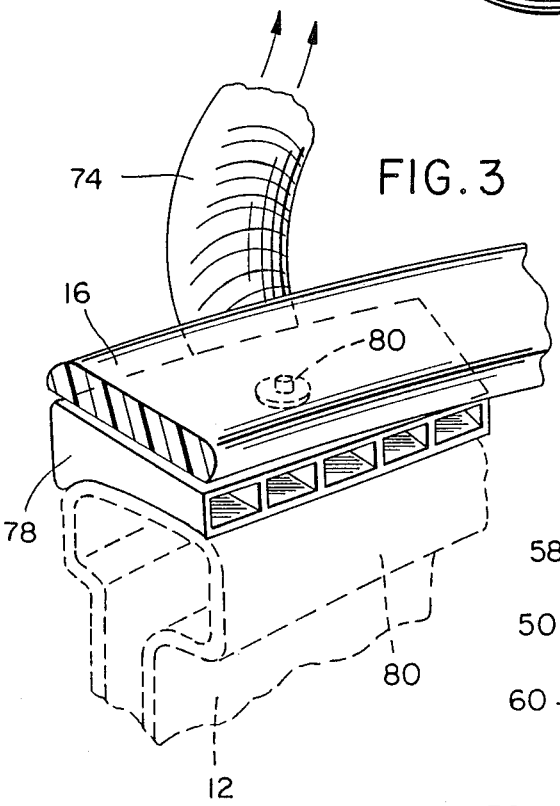
FIG. 3 is a fragmentary perspective view illustrating the manner in which a pressure sensitive seat switch may be utilized in conjunction with the inlet end portion of the inlet hose for actuating the toilet bowl venting and deodorizing structure.

With attention now invited more specifically to FIG. 6, the numeral 82 generally designates a battery pack serially connected within a typical loop circuit 84. The switch 80 is also serially connected in the circuit 74, as is the motor 38, and the loop circuit 84 additionally may include a temperature responsive adjustable resistor 86 serially connected therein.

The pressure switch 80 is constructed such that the switch is maintained in an open position when the seat 16 is in the position thereof illustrated in FIG. 1 and a downward force of a predetermined magnitude is not being applied to the seat 16. However, should a user of the toilet assembly 10 assume a seated position on the seat 16, the predetermined downward force on the seat 16 will be exceeded and the switch 80 will be closed, thereby electrically connecting the battery pack 82 to the motor 38.

If the ambient temperature is relatively cool, the resistor 86 will reduce the amount of current supplied to the motor 38 from the battery pack 82. On the other hand, if the ambient temperature is relatively high, the resistor 86 will supply a greater amount of current from the battery pack 82 to the motor 38 and the axial flow impellers 58 and 60 will be rotated at a higher speed.

Upon operation of the motor 38 the axial flow impellers 58 and 60 draw gasses into the housing 20 through the inlet fitting 24 and pump those gasses through the filter panels 50 and thereafter outwardly of the openings 36 in close proximity to the air freshening or deodorizing material 68. Of course, the air drawn into the housing 20 is drawn into the fitting 78 from the interior of the toilet bowl 12. As a result, the air handled by the structure 18 passing through the housing 20 is fltered and deodorized before being discharged back into the ambient air adjacent the toilet assembly 10.

It is deemed quite evident that upon removal of the top wall 22 and the fasteners 39, all of the interior components of the housing 20 may be removed therefrom through the open upper end of the housing. Further, upon removal of the upper portion 52 of the peripheral wall 28, the filter panels 50 may be readily removed and replaced without total removal of all components within the housing 20.

Figure 7:
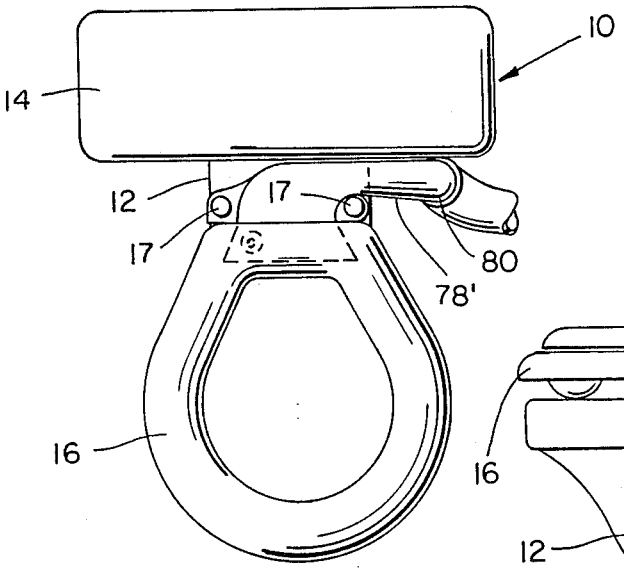
FIG. 7 is a top plan view similar to FIG. 1 but illustrating a modified form of inlet fitting for the inlet hose of the invention.
Figure 8:
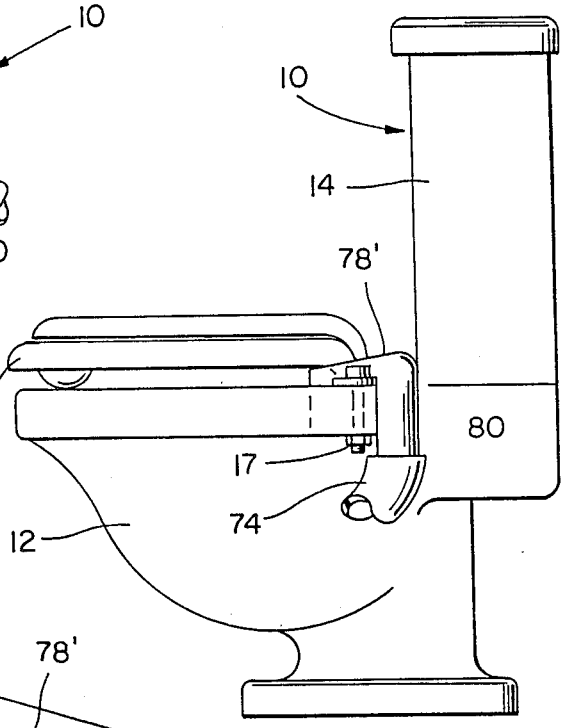
FIG. 8 is an enlarged side elevational view of the assemblage illustrated in FIG., 7.
Figure 9:
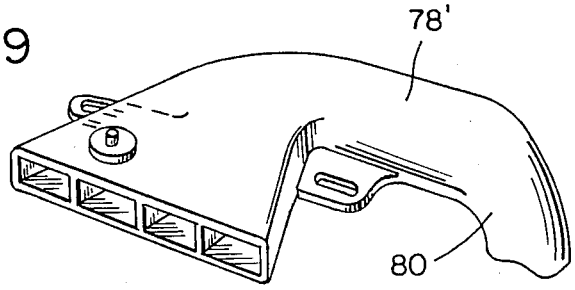
FIG. 9 is an enlarged perspective view of the inlet fitting illustrated in FIGS. 7 and 8.

With attention now invited more specifically to FIGS. 7–9 of the drawings, there may be seen a modified form of fitting 78′ which is mounted to the toilet bowl 12 through the utilization of the same fasteners 17 utilized to mount the hinges for the seat 16 from the toilet bowl 12. In addition, the fitting 78′ includes an outwardly and downwardly directed inlet neck 80 over whose outlet end the inlet end of the conduit 74 is telescoped.

Independent of whether the fitting 78 or the fitting 78′ is used, the operation of the toilet bowl ventilating and deodorizing structure 18 is the same. Upon closing of the switch 80, the motor 38 is actuated and air is drawn from within the toilet bowl 12, through the fitting 78 and conduit 74 and into the upper inlet end of the housing 20. The air then passes through the filter panels 50 and passes outwardly through the openings 36 in close proximity to the deodorizing agent 68. As hereinbefore set forth, the filter panels 50 may be removed by removing the upper portion 52 of the peripheral wall 28 and all of the remaining internal components within the housing 20 may be removed by removing the fasteners 38, removing the top wall 22 and thereafter upwardly displacing the remaining components from the open top of the housing 20.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A toilet bowl ventilating and deodorizing structure for use in conjunction with a bathroom toilet bowl and seat assembly, said structure including a hollow housing having inlet and outlet openings, said inlet opening being adapted to have the outlet end of conduit means extending from the upper rim portion of the toilet bowl operatively communicated therewith, said housing including opposite end walls and peripheral side walls extending between and interconnecting said end walls, one of said end walls being removably mounted relative to the remainder of said housing and havng said inlet opening formed therein, motor means mounted within said housing adjacent the other end wall thereof and including a rotatable output shaft exposed end portion, an intermediate length portion of said housing including air filtering means removably supported therein and extending thereacross and incorporating a pair of separate filter panels disposed on opposite sides of an intermediate portion of said exposed end portion of said shaft, one of said peripheral walls including at least a portion thereof removably supported from the remainder of said housing and closing a lateral opening defined by said housing registered with said air filtering means and through which said panels may be separately removed for replacement or servicing, said shaft exposed end portion including first axial flow impeller means mounted thereon between said filter means and said one end wall and second axial flow impeller means mounted thereon between said filter means and said motor means, at least one of said peripheral walls including a portion thereof spaced therealong from said second axial flow impeller means toward said motor having said outlet opening formed therein, said housing including at least two opposite side outlet openings formed therein and support means adjacent said other end wall supporting a deodorizing agent closely adjacent said outlet openings, said support means comprises a body mounted against the inner surface of said other end wall and including a center recess in which said motor is seated, said body supporting said deodorizing agent therefrom intermediate said recess and the outer peripheral portions of said body.

2. The assembly of claim 1 wherein said motor is mounted to the inner surface of said other end wall within said recess through the utilization of fasteners secured through said other end wall, said body, motor and impeller means being removable through the end of said housing normally closed by said one end wall when said one end wall is removed and said fasteners are removed.

3. The assembly of claim 2 including a spider removably received within said housing immediately inward of said one end wall and from which the outer terminal end of said exposed shaft end portion is journalled.

* * * * *